United States Patent [19]

Leskinen

[11] 4,342,541

[45] Aug. 3, 1982

[54] IMPELLER ASSEMBLY FOR A CENTRIFUGAL BLOWER

[75] Inventor: Seppo J. Leskinen, Vaserskog, Finland

[73] Assignee: Oy Nokia AB, Helsinki, Finland

[21] Appl. No.: 261,560

[22] Filed: May 7, 1981

Related U.S. Application Data

[63] Continuation of Ser. No. 61,303, Jul. 27, 1979, abandoned.

[30] Foreign Application Priority Data

Aug. 23, 1978 [FI] Finland ..... 782578

[51] Int. Cl.[3] ..... F01D 29/28

[52] U.S. Cl. ..... 416/186 R; 416/188

[58] Field of Search ..... 416/186, 188, 213 R; 415/213 R, 215; 29/156.8 CF

[56] References Cited

U.S. PATENT DOCUMENTS

| | | | |
|---|---|---|---|
| 3,139,265 | 6/1964 | Lindquist | 416/186 |
| 3,298,444 | 1/1967 | Haas | 416/186 |
| 3,507,581 | 4/1970 | Jensen | 29/156.8 CF |

FOREIGN PATENT DOCUMENTS

| | | | |
|---|---|---|---|
| 140542 | 12/1948 | Australia | 416/186 R |
| 2622018 | 12/1977 | Fed. Rep. of Germany | 415/213 R |
| 1355428 | 2/1964 | France | 416/186 |

*Primary Examiner*—Leonard E. Smith

*Attorney, Agent, or Firm*—Dressler, Goldsmith, Shore, Sutker & Milnamow, Ltd.

[57] ABSTRACT

Disclosed is an impeller in a centrifugal blower, especially a high-pressure blower, wherein the curved part of the front plate of the impeller is replaced by a conical supporting ring. The upper edge of the supporting ring is attached to the blades of the impeller and the lower edge to the cylindrical suction ring of the impeller. A guide ring made of thin plate is mounted inwards from the supporting ring.

1 Claim, 1 Drawing Figure

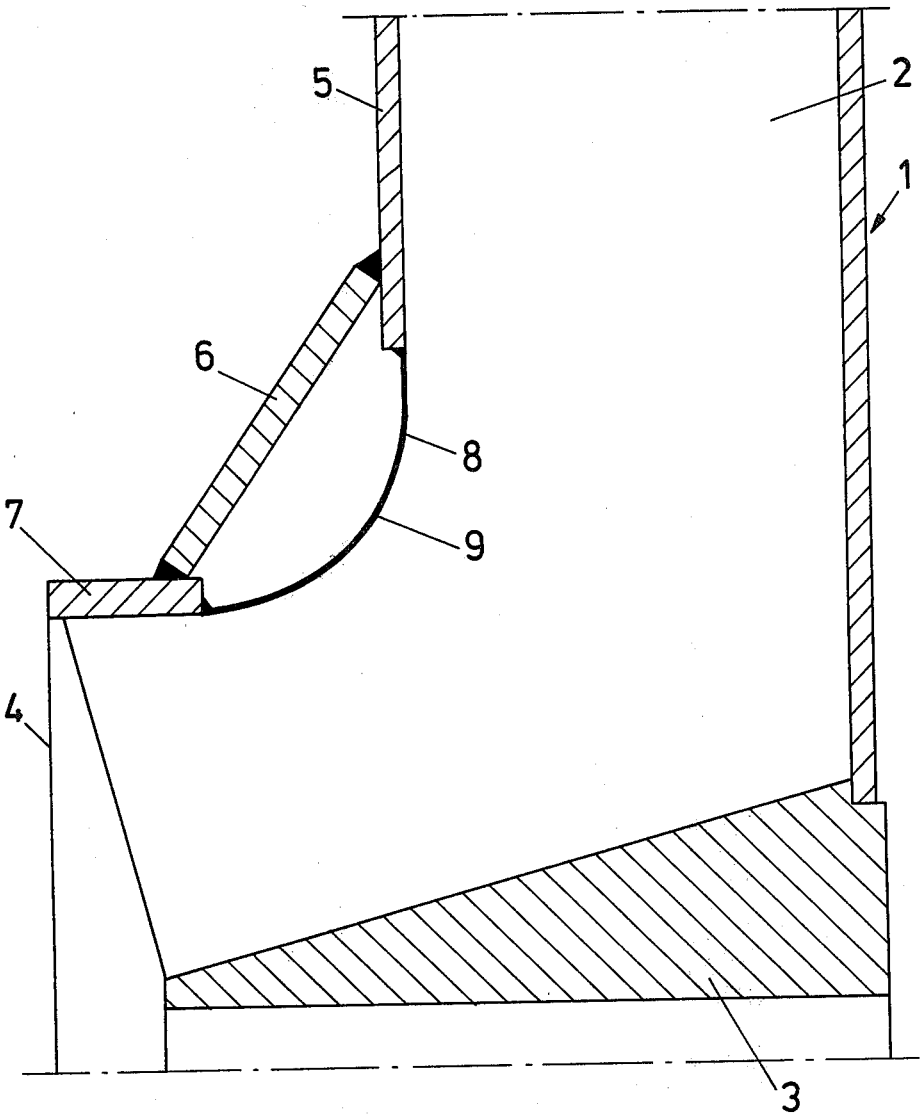
5
2
1
6
8
7
9
4
3

IMPELLER ASSEMBLY FOR A CENTRIFUGAL BLOWER

This is a continuation, of application Ser. No. 61,303, filed July 27, 1979, now abandoned.

BACKGROUND OF THE INVENTION

The present invention relates to an impeller in a centrifugal blower, especially a high-pressure blower.

In order to achieve high efficiency, the impeller of a centrifugal blower must have rounded, aerodynamically correct forms. However, especially the rounding of the front plate of the impeller causes problems in manufacturing techniques, since the thicknesses of material are rather great. The rounding of the front plate is therefore considerably expensive.

SUMMARY OF THE INVENTION

The curving part of the front plate can, according to the present invention, be replaced by a conical supporting ring, by means of which loads are transferred to the blades and the cylinder ring of the impeller. The aerodynamically correct form for the supporting ring is achieved by means of a guide ring made of thin plate; the manufacturing cost of this guide ring is low. The characteristics of the invention are given in the accompanying claim.

The strength of the combined structure according to the invention is higher than the strength of a rounded, i.e. curved, front plate, since the invention eliminates the bending stresses produced in the curved part and the stress peak produced in the curved front plate and the curved part of the blades.

Owing to its flexibility, the guide ring does not receive stresses, but stresses are transferred from the front plate to the suction ring via the supporting cone, which can be manufactured at low cost in, for example, a rounding machine. This eliminates the stress peak otherwise inevitably produced in the center point of the rounding in both the blades and in the suction ring, and a stress level approx. 20–30% lower is achieved than by prior known structures. This stress peak is crucial for the dimensioning of the entire impeller.

Thus the essential point is that in the structure according to the invention the aerodynamical design and the strengths design have been carried out separately, whereby a structure is obtained which is optimal both in strength and aerodynamically and less expensive to manufacture than known structures.

The aerodynamically correct form is achieved by means of a guide plate which is made from thin plate and is easy to produce at low cost by compression tools, pressure turning, etc. The radius of curvature is not limited as is the case in structures produced by turning, and in certain cases this is very important considering the performance of the blower.

The invention can be applied to conventional impellers, but it is especially significant in high-pressure blowers, in which the blades of the impeller extend as far as the hub of the impeller and in which that part of the blades which faces the suction opening has been designed in an aerodynamically appropriate way.

BRIEF DESCRIPTION OF THE DRAWING

One embodiment of the invention is described below with reference to the accompanying drawing, but without limiting the invention to this embodiment.

DESCRIPTION OF A PREFERRED EMBODIMENT

In the embodiment depicted in the drawing the impeller 1 of a high-pressure blower has a structure in which the blades 2 extend as far as the hub 3 of the impeller and in which that part of the blades 2 facing the suction opening 4 has been designed approximately. The rounded part of the front plate 5 has been replaced by a conical support ring 6; the upper edge of this ring has been attached to the front plate 5 and its lower edge to the cylindrical suction ring 7 of the impeller. A guide plate 8 made of thin plate has been mounted inwards from the supporting ring 6; the stress peak of the guide ring 8 is indicated by 9.

What is claimed is:

1. An impeller assembly for a centrifugal blower comprising:

a back plate joined to a central hub, a plurality of blades extending generally radially of said hub and said back plate, a generally radially extending front plate, a generally cylindrical axially extending suction ring disposed ahead of said front plate, said blades being disposed between and adjacent said front plate and said back plate, and said suction ring and said hub, a frusto-conical supporting ring extending between and secured to said front plate and said suction ring, and guide ring means extending between said front plate and said suction ring and disposed inwardly of said supporting ring defining aerodynamically correct fluid flow passages between said blades, wherein said guide ring means essentially does not receive stresses relative to said supporting ring which transfers stresses from said front plate to said suction ring.

* * * * *